US006022200A

United States Patent [19]

Myers

[11] Patent Number: 6,022,200

[45] **Date of Patent: *Feb. 8, 2000**

[54] VERTICAL ARRANGEMENT OF A DUAL HEAT EXCHANGER/FAN ASSEMBLY

[75] Inventor: Wayne K. Myers, Loraine, Ill.

[73] Assignee: Gardner Denver Machinery, Inc., Quincy, Ill.

[ * ] Notice: This patent is subject to a terminal disclaimer.

[21] Appl. No.: 08/935,668

[22] Filed: Sep. 23, 1997

Related U.S. Application Data

[63] Continuation of application No. 08/734,119, Oct. 21, 1996, Pat. No. 5,720,599.

[51] Int. Cl.[7] ..... F04B 17/00

[52] U.S. Cl. ..... 417/423.15; 417/313; 417/424.2; 165/97; 62/90

[58] Field of Search ..... 417/313, 360, 417/423.14, 423.15, 424.1, 424.2; 165/97, 122; 62/90

[56] References Cited

U.S. PATENT DOCUMENTS

| | | | |
|---|---|---|---|
| 3,291,385 | 12/1966 | Williams et al. . | |
| 4,249,596 | 2/1981 | Tutak et al. . | |
| 4,341,506 | 7/1982 | Klein . | |
| 4,394,111 | 7/1983 | Wiese et al. . | |
| 4,420,293 | 12/1983 | Hofmann . | |
| 4,763,723 | 8/1988 | Granetzke . | |
| 4,929,161 | 5/1990 | Aoki et al. . | |
| 4,968,231 | 11/1990 | Zimmern et al. . | |
| 5,020,973 | 6/1991 | Lammers . | |
| 5,022,828 | 6/1991 | Myers . | |
| 5,087,178 | 2/1992 | Wells . | |
| 5,106,270 | 4/1992 | Goettel et al. . | |
| 5,199,858 | 4/1993 | Tsuboi et al. . | |
| 5,219,016 | 6/1993 | Bolton et al. . | |
| 5,226,285 | 7/1993 | Dankowski | 165/97 |
| 5,259,206 | 11/1993 | Dankowski | 165/122 |
| 5,282,726 | 2/1994 | Warren . | |
| 5,287,916 | 2/1994 | Miller . | |
| 5,375,649 | 12/1994 | Nilsen et al. | 165/97 |
| 5,378,119 | 1/1995 | Goertzen | 417/313 |
| 5,447,422 | 9/1995 | Aoki et al. . | |
| 5,466,134 | 11/1995 | Shaffer et al. . | |
| 5,666,813 | 9/1997 | Brune | 62/90 |
| 5,720,599 | 2/1998 | Myers | 417/423.15 |

FOREIGN PATENT DOCUMENTS

| | | |
|---|---|---|
| 6249165 | 9/1994 | Japan . |
| 1322395 | 7/1973 | United Kingdom . |

OTHER PUBLICATIONS

*Lubrication*, Compressors II, vol. 59, Apr.–Jun. 1973.

*Primary Examiner*—Charles G. Freay
*Assistant Examiner*—Cheryl J. Tyler
*Attorney, Agent, or Firm*—Robert F. I Conte; Lee Mann Smith McWilliams Sweeney & Ohlson

[57] ABSTRACT

There is a cooler fan assembly having a shroud, a fan blade and motor to produce an air flow, a first heat exchanger, and a second heat exchanger. The first heat exchanger cools compressed air; the second heat exchanger cools a coolant. The shroud defines an air passageway. The air passageway directs an air flow produced by the fan blade and motor in a path having a direction going into an inlet portal of the shroud and out of a discharge portal of the shroud. The first heat exchanger is coupled to the shroud and is in the path of the air flow. The second heat exchanger is coupled to the shroud and is in the path of the air flow. The fan blade and motor is completely disposed within the shroud.

12 Claims, 4 Drawing Sheets

VERTICAL ARRANGEMENT OF A DUAL HEAT EXCHANGER/FAN ASSEMBLY

The present application is a continuation of application Ser. No. 08/734,119 filed Oct. 21, 1996, now U.S. Pat. No. 5,720,599. The invention relates to a cooler fan assembly, and more particularly, to a cooler fan assembly used with air compressors.

FIELD

Background

Air compressors utilize cooler fan assemblies to cool compressed air generated by the compressor and to cool a coolant circulating through a compressor. A previous cooler fan assembly for air compressors included a cooler fan, a fan case, a fan guard, and two heat exchangers. U.S. Pat. Nos. 5,087,178 (Wells) and 4,968,231 (Zimmern) illustrate how cooler fan assemblies operated in conjunction with rotary screw compressors to cool compressed air and a coolant.

Typically the previous cooler fan circulated air over at least two heat exchangers. Circulating air over the heat exchangers reduced the temperature of the air or coolant circulating through the heat exchangers.

The fan case of the previous cooler fan assembly helped to direct air flow over the heat exchangers. The fan case had an air entry opening and an air outlet opening. A fan blade was located at the entry opening.

The exchanger for the coolant and the exchanger for the compressed air were located laterally side by side, as in U.S. Pat. No. 4,929,161 (Aoki). The exchangers alternatively were axially opposite each other as in U.S. Pat. No. 5,447,422 (Aoki). A motor powering the fan was located outside of the casing and axially opposite the fan blade and the heat exchangers.

Industry has tried to improve cooling of the compressed air. For instance, U.S. Pat. No. 4,929,161 (Aoki) uses additional exchangers to increase the amount of compressed air cooled. U.S. Pat. No. 5,447,422 (Aoki) uses an assembly that has additional exchangers and a second air flow direction to increase the amount of compressed air cooled. These solutions increase the cost and complexity of the compressor unit.

Previous cooling fan assemblies had a small amount of space around the heat exchangers. The small amount of space interfered with hook-up to the compressor. Industry has tried to solve this problem by developing intricate piping systems to connect the heat exchangers to the compressor unit. These piping systems, however, are costly, difficult to install and repair.

A further problem associated with these previous assemblies is the high level of noise the cooler fans create. The noise level makes it difficult to carry on a conversation around the compressor. In addition, the noise level is annoying and irritating to operators of the compressors.

Industry uses both oil-injected compressors and the more recent water-injected compressors. Both of these types of compressors use cooler fan assemblies. The use of oil rather than water has drawbacks, i.e., oil is a pollutant.

SUMMARY

Applicant's cooler fan assembly improves the cooling of the compressed air and coolant. To improve cooling, Applicant inventively sucks air through a heat exchanger used to cool the compressed air and inventively blows air through the heat exchanger used to cool the coolant. Applicant, by inventively sucking air through one heat exchanger and blowing it through another, improves upon the cooling of the compressed air and coolant.

To increase working space, Applicant has inventively disposed its heat exchangers axially spaced from each other. The inventive axial spacing between the heat exchangers reduces the need for complex piping systems.

In addition to reducing the need for complex piping systems, Applicant's cooler fan assembly further reduces manufacturing costs and complexity. Applicant by inventively positioning its heat exchangers relative to a cooler fan eliminates the need for a fan guard.

Applicant's cooler fan assembly reduces the noise level of the cooler fan. To reduce noise level, Applicant has inventively positioned the cooler fan relative to the shroud and the exchangers. The positioning of the cooler fan reduces noise level.

Accordingly, Applicant's cooler fan assembly adapted for use with an air compressor has a shroud, a means to produce an air flow, a compressed-air heat exchanger and a coolant heat exchanger.

The shroud has an air inlet portal and an air discharge portal. The shroud defines an air passageway. The air passageway directs the air flow to move in a path having a direction into said inlet portal and out of said discharge portal.

The compressed-air heat exchanger is coupled to the shroud so that the compressed-air heat exchanger is in the path of said air flow. The coolant heat exchanger is coupled to the shroud so that the coolant heat exchanger is in the path of the air flow. The means to produce an air flow is completely disposed within the shroud.

In one embodiment of my invention the means to produce an air flow is a fan motor and a fan blade.

In another embodiment of my invention the compressed-air heat exchanger is disposed in the path of said air flow so that the compressed-air heat exchanger is downstream of the means to produce an air flow. The coolant heat exchanger is disposed in the path of the air flow so that the coolant heat exchanger is upstream of the means to produce an air flow.

In still another embodiment of my invention, the cooler fan assembly has a portion of said shroud defining a constricted air passageway. The constricted air passageway is in the path of the air flow. The constricted air passageway is axially spaced from the air inlet portal and the air discharge portal.

Other desirable results and novel features of the present invention will become more apparent from the following drawings, detailed description and the accompanying claims.

DETAILED DESCRIPTION

Referring to FIGS. 1–9, we see an example of Applicant's cooler fan assembly. The cooler fan assembly depicted in FIGS. 1–9 is designed for use in conjunction with a rotary screw water-injected (oil-free) air compressor. The cooler fan shroud assembly has a shroud (15), a means to propel ambient air such as a cooler fan (17), a first exchanger (19), and a second exchanger (21).

Figure 1:
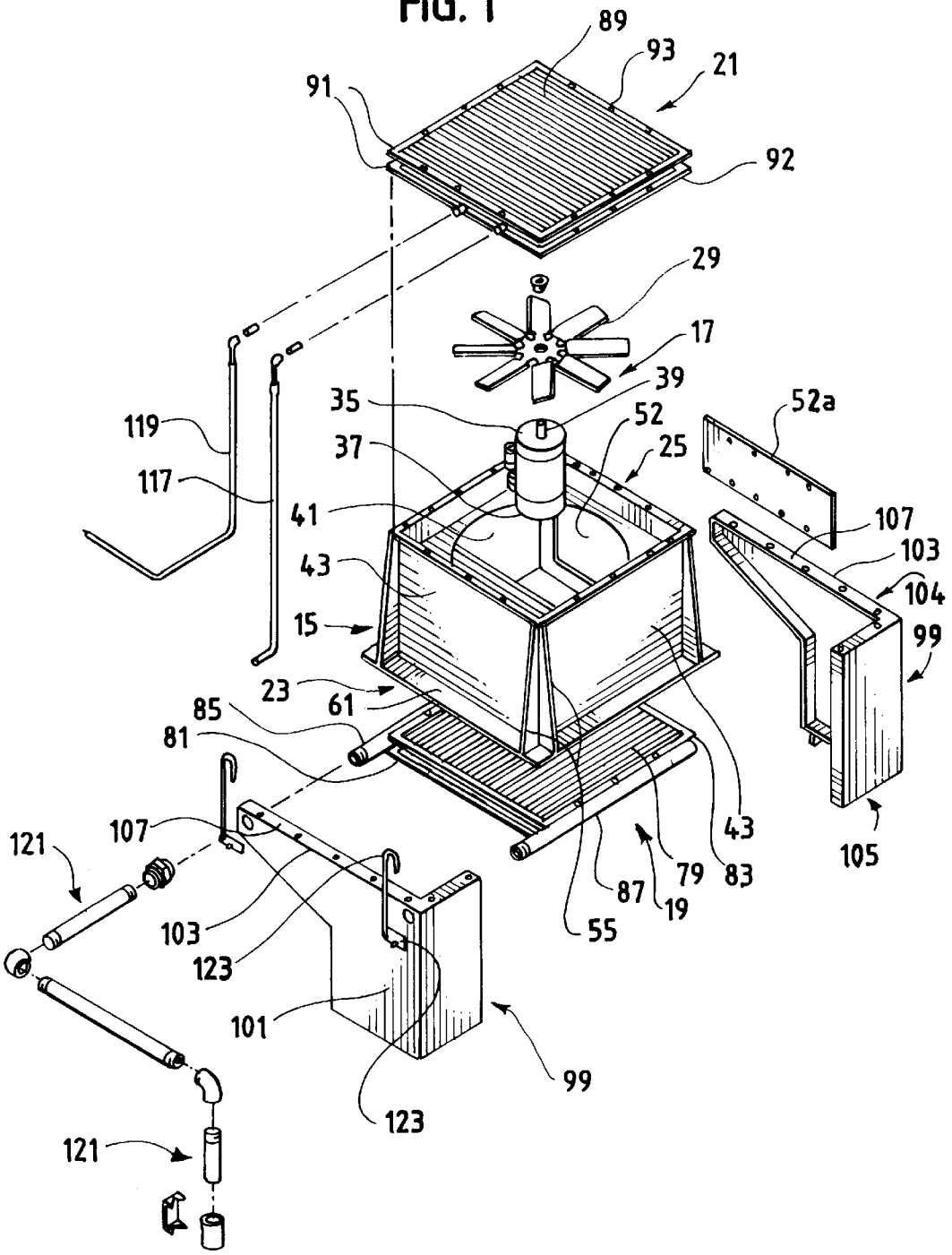
FIG. 1 is an exploded view, in perspective, of the cooler fan shroud assembly of the present invention shown with supply and discharge piping connections.
Figure 2:
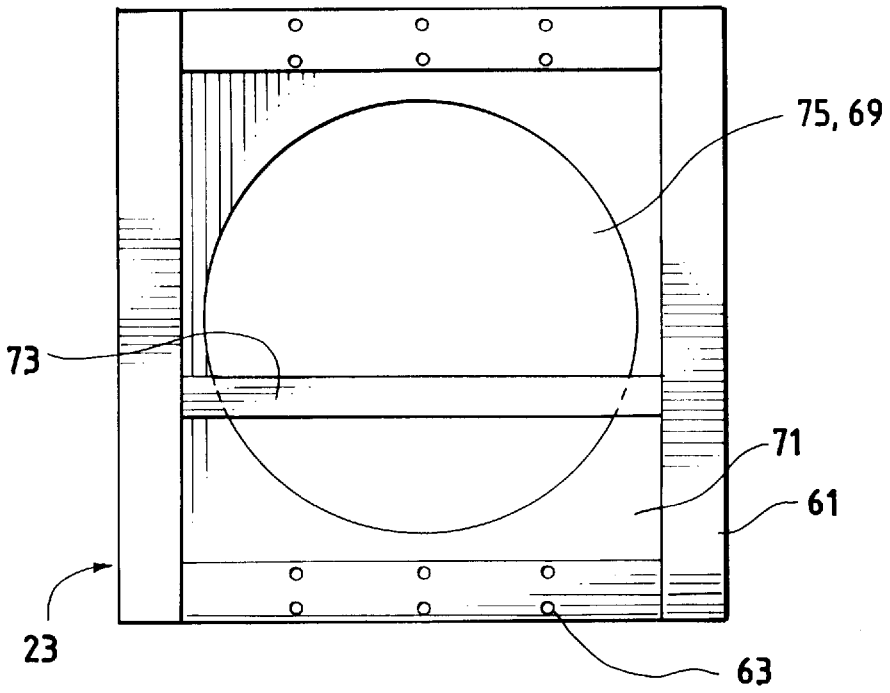
FIG. 2 is a bottom view of the shroud of the present invention.
Figure 3:
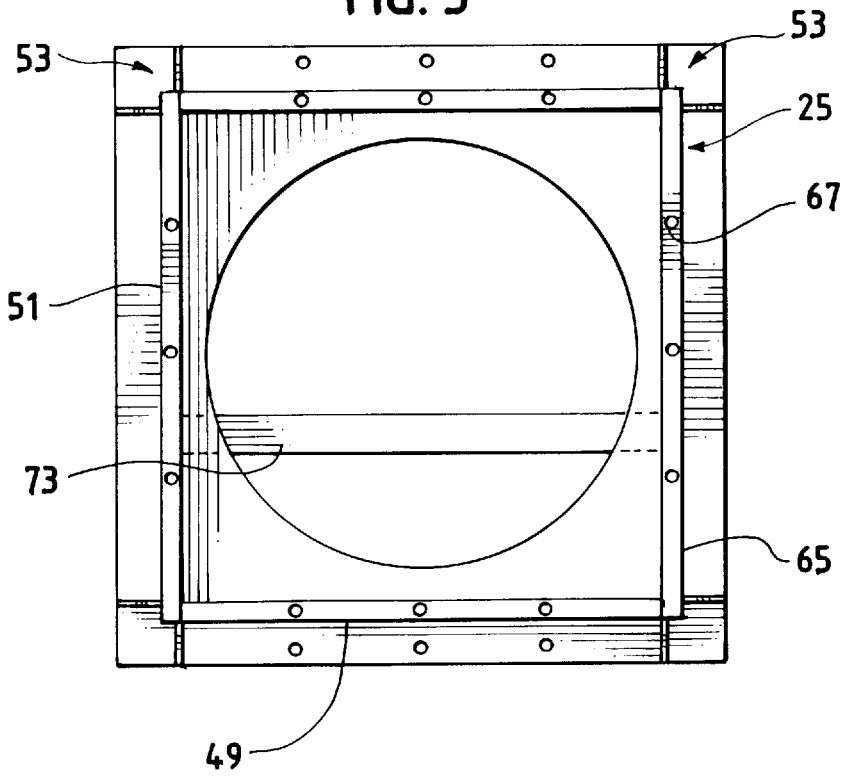
FIG. 3 is a top view of the shroud of the present invention.
Figure 4:
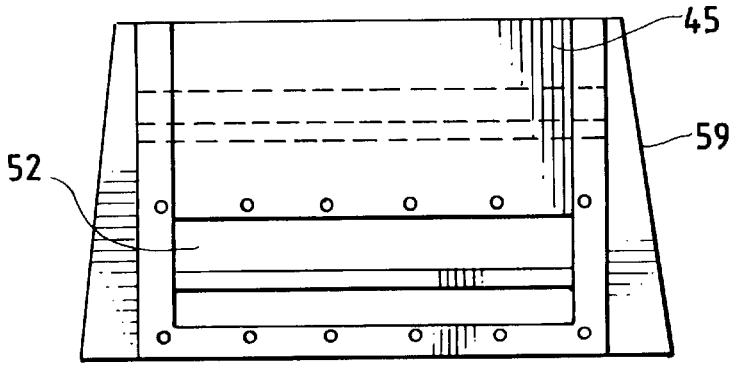
FIG. 4 is a side view of the shroud of the present invention.
Figure 5:
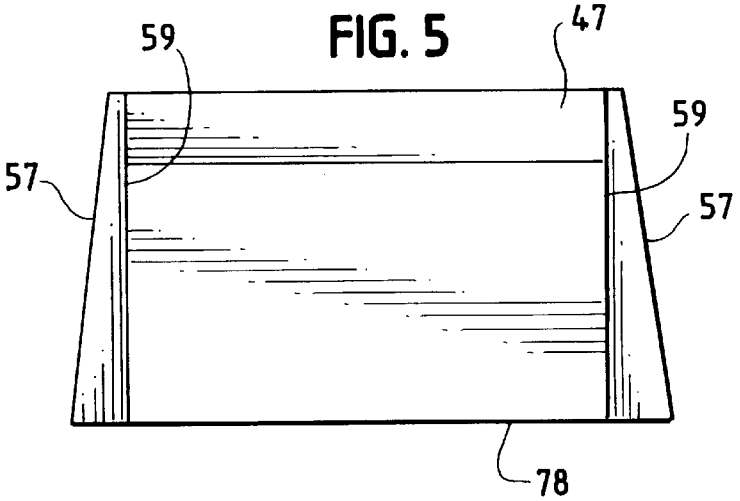
FIG. 5 is another side view of the shroud; the side view is adjacent to the side view shown in FIG. 4.
Figure 6:
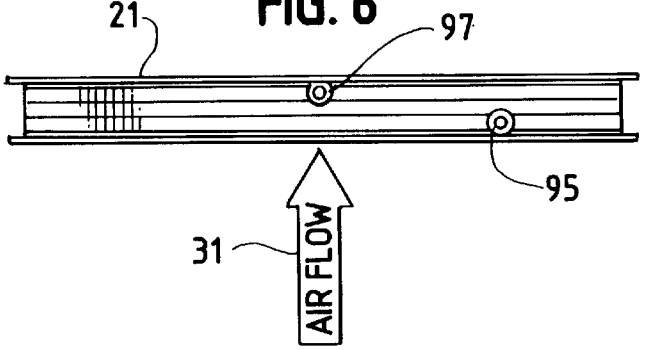
FIG. 6 is a side view of a heat exchanger of the present invention.

The shroud has an air inlet portal (23) (FIG. 2) and an air discharge portal (25) (FIG. 3). The discharge portal is axially opposite the inlet portal. The shroud defines a continuous air passageway (27).

The first heat exchanger is connected to the shroud. The second heat exchanger is connected to the shroud. The first heat exchanger is axially opposite the second heat exchanger. The first heat exchanger is disposed over the inlet portal. The second heat exchanger is disposed over the discharge portal.

The cooler fan is disposed completely within the shroud. The cooler fan is axially opposite the inlet portal and the discharge portal. The cooler fan is between the inlet and discharge portals. The cooler fan is axially opposite the first exchanger and the second exchanger, the cooler fan being between these exchangers.

The cooler fan shroud assembly sucks air through the first heat exchanger and blows air out through the axially opposite second heat exchanger. In more detail, the cooler fan produces an air flow. The air passageway directs the air flow to move in a path having a direction (31) (FIG. 7) into said inlet and out of said discharge portal. Specifically, the path has a direction in which the air is sucked over the first heat exchanger, passes through the air inlet portal, is directed by the air passageway over a fan blade, passes through a constricted air passageway which is part of said air passageway, passes through the discharge portal and is lastly blown through the second heat exchanger. For reference, the air can be considered a stream traveling in the path and direction from the inlet portal to the discharge portal.

Referring in more detail to the cooler fan, the cooler fan has a fan blade (29) and a fan motor (33). The fan motor has a front end (35) which faces the blade and an axially opposite rear end (37). The fan motor has a shaft (39). The shaft extends axially out of the fan's front end and in a direction axially away from the fan's rear end. The fan blade is disposed axially opposite the first and second heat exchangers. The fan blade is also between the first and second exchangers.

The fan motor used in the shown embodiment is preferably a totally enclosed air over motor having a single long shaft for direct drive. The motor is 900 r.p.m., 600 Hz, 7-½ horsepower and 3-phase. The motor has NEMA Design B specifications, uses Class B or F insulation, and has a 40° C. ambient temperature rating and a 256T frame. The motor is 460 volts. The basic part number of the motor is 24CA. The part number prefix is 215. The vendors are General Electric, Central Electric, Reliance or Siemens Energy.

Referring in more detail to the shroud and FIGS. 1–5, the shroud has four walls. The four walls forming the shroud each have an interior surface (41). The interior surface of each wall helps to define the interior of the shroud and the air passageway. The four walls also have exterior surfaces (43) opposite the interior surfaces. The four walls can be referred to as a first (45), second (47), third (49) and fourth (51) wall. The shroud has an inspection portal (52) cut out in one of the shroud's four walls. The inspection portal has a removable inspection plate **(52*a*)** thereon.

The four walls are joined to define the shape of the air passageway. The discharge portal is at one end of the air passageway. The inlet portal is at another axially opposite end of the air passageway. The air passageway has a rectangular shape.

Each shroud wall is adjacent to two other shroud walls. Each of the adjacent walls are joined together at a juncture (53). A support (55) is located at each juncture (53). Each support forms a sort of triangular post. Each triangular post has a first triangular flange (57) and a second triangular flange (59).

A base frame (61) is located at the inlet portal of the shroud. The base frame surrounds the inlet portal of the shroud. The base frame extends out from the shroud's exterior surface and away from its interior surface. The base frame lies in a plane perpendicular to and at a right angle to the wall's exterior surfaces (43). The base frame extends outward about 6-½ inches. The base frame has plurality of bolt holes (63) therethrough.

A top frame (65) is located at the discharge portal of the shroud. The top frame surrounds the discharge portal of the shroud. The top frame extends out from the exterior surface of the shroud and away from the shroud's interior surface. The top frame lies in a plane perpendicular to and at right angles to the wall's exterior surfaces. The top frame extends outward about 2-½ inches. The top frame has a plurality of bolt holes (67) therethrough.

Within the shroud is a constricted air passageway (69). The constricted air passageway is a part of the air passageway defined by the shroud. The constricted air passageway comprises a partition (71) having an opening. The opening is circular. The partition is disposed in a plane parallel to the base frame and parallel to the top frame. The partition is disposed so as to be axially further away from the base frame than it is from the top frame. The partition is about 3-½ times further axially away from the base frame than it is from the top frame.

A fan support (73) is disposed within the shroud. The fan support can be referred to as a slat. The slat lies in a plane parallel to the base frame. The slat is in a plane axially spaced from the base frame in a direction axially towards the top frame. The slat extends from the second wall (47) to the axially opposite fourth wall (51) of the shroud. The slat also runs parallel to the third wall (49) and the first wall (45). The slat is axially closer to the third wall than to the first wall, the slat being about twice as far from the first wall.

In an example of a specific construction, the shroud has an air passageway (27) having an axial length measured from the base frame to the top frame of about 35.5 inches. The axial distance separating the interior surface of opposite walls is about 50 inches. The air flow distance from the inlet portal to the circular opening (75) (FIG. 2) is about 28.38 inches. The circular opening has a diameter of about 44.8 inches.

The second and fourth walls have a length of 63 inches. The first and third walls have a length of 50 inches. The longer walls have a sort of trapezoidal shape. The base of the trapezoidal wall is disposed at the air inlet portal of the shroud and is connected to the shroud base frame. The tapered side of a trapezoidal wall forms the first triangular flange (57) of a triangular post. The second flange of the triangular post is coupled to the shroud to complete the support.

The first heat exchanger has a core (79). The core comprises a grill through which compressed air flows. The core is square and is surrounded by a frame (81). The frame is square and has a shroud side (83). The shroud side is on the side of the first heat exchanger which faces towards the shroud's interior. The frame has a side axially opposite the non-shroud side. The shroud side of the frame attaches to the shroud. Bolt holes or the like extend through both sides of the frame.

Located axially between the frame's two sides is an air supply pipe (85) and an air discharge pipe (87). The air supply pipe borders and runs along a first side of the core. The air discharge pipe borders and runs along an axially opposite second side of the core. The first heat exchanger can be an aftercooler. The aftercooler in the shown example is manufactured by Thermal Transfer Products, Ltd., having a design pressure of 250 PSIG and a design temperature of 350° F.

The second heat exchanger has a core (89) surrounded by a frame (91). The core is square and comprises a grill through which coolant such as water flows. The frame, which is square, surrounds the exchanger's core. The square frame has a shroud side (92). The shroud side is on the side of the second heat exchanger which faces towards the shroud's interior. The shroud side of the frame attaches to the shroud. The frame has a non-shroud side (93). Bolt holes or the like extend through both sides of the frame.

Located axially between the two frame sides of the second heat exchanger are a water inlet (95) and a water outlet (97). The water inlet and water outlet (97) are located on a same side of the core. The water outlet is axially closer to the non-shroud side of the frame than to the shroud side. The water inlet is axially closer to the shroud side of the frame than to the non-shroud side of the frame. The second heat exchanger can be a water cooler. The water cooler shown in the example is manufactured by Thermal Transfer Products, Ltd., Model A088908, having a design pressure of 250 PSIG and a design temperature of 350° F.

A mounting structure or coupling means is used to mount the shroud assembly to the air compressor. In the shown embodiment the mounting structure or coupling means comprises a mounting support (99). The support has a leg portion (101) and an arm portion (103). The leg portion has a base end (105) and an arm end (104) axially opposite the base end. The base end has a base surface. The arm portion (103) is connected to the arm end (104). The arm portion extends transversely to the leg portion. The arm has a shroud side (107) axially opposite the base end (105).

The base surface of the mounting support is attached to the base of the compressor (108). The base end is attached so that the arm of the support extends above and over a compressor motor (109) (FIG. 9) used to drive the air end. The arm of the support is transverse to the axis of the motor (109). The shroud side of the arm is attached to the inlet side of the shroud assembly and more particularly to the shroud base frame. The support forms an underpass in which the motor lies. The underpass ensures that the cooler fan shroud assembly does not produce weight on the compressor motor (109).

Figure 7:
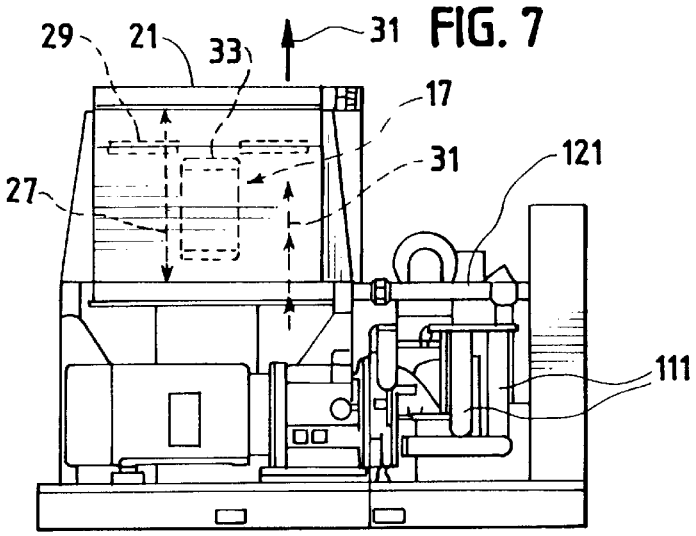
FIG. 7 is a frontal elevation of a rotary screw air compressor utilized in conjunction with the cooler fan assembly of the present invention.
Figure 8:
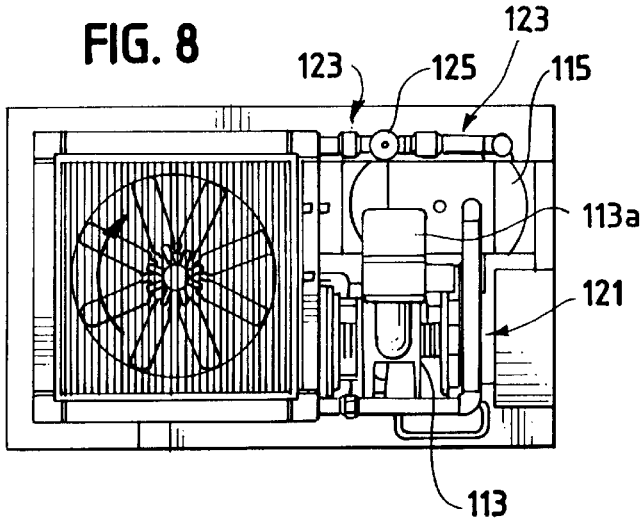
FIG. 8 is a top view of a rotary screw air compressor utilized in conjunction with the cooler fan assembly.
Figure 9:
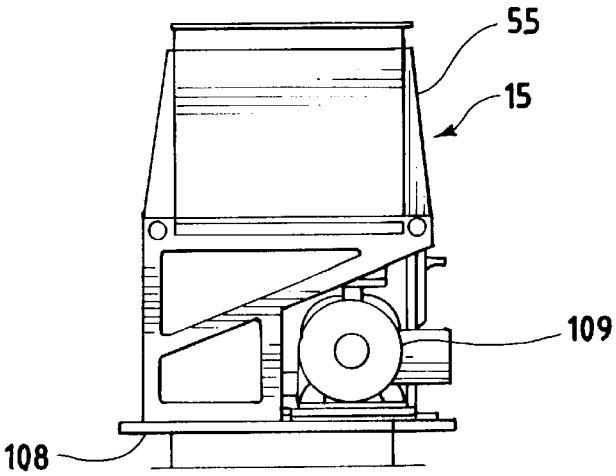
FIG. 9 is a side view of a rotary screw air compressor with Applicant's cooler fan assembly.

Referring to FIGS. 7, 8 and 9, we see an illustration of an assembled cooler fan assembly. As stated, the cooler fan is located completely within the shroud. The rear end of the fan motor is disposed so that it does not protrude outside of the shroud. The rear end is disposed nearer to the inlet portal than the discharge portal. The cooler fan's shaft extends axially from the motor's front end towards the shroud's top frame. The fan blade lies within the circular opening. The circular opening and fan blade are positioned so that a horizontal plane enclosing the diameter of the circular opening also encloses a diameter of the circular fan blade.

The heat exchanger's shroud side frame is mounted to the base frame of the shroud. The mounting or coupling is made via a coupling means such as screws. The shroud frame side of the second exchanger is mounted to the top frame of the shroud. The mounting again is done via a coupling means such as screws. The shroud assembly is mounted to the mounting support. The mounting support is mounted to the base.

In a coolant-injected air compressor used with Applicant's invention, the coolant, such as water, passes through a filtering means (111) into an air compressing means (113) such as an air end. The air-end's inlet to receive ambient air is shown as 113*a*. The water is discharged from the air end into a means to separate the coolant and the compressed air such as a separator (115). The water from the separator (115) is forced up through a supply means (117) such as a piping structure and into Applicant's second heat exchanger.

Applicant's cooler fan blows air through the second heat exchanger to cool the water circulating through the heat exchanger. The cooled water then passes from the heat exchanger through a discharge means (119), back into the filter means and back into the air end. The water is thus continuously circulated through the air end and second heat exchanger.

Compressed air from the air end is discharged into the separator along with the coolant. The compressed air flows from the separator (115) via a supply means (121) to the aftercooler.

The cooler fan sucks air through the aftercooler and further cools the compressed air. The compressed air from the aftercooler flows through another discharge means (123). The discharge means (123) includes a separating means (125) such as a moisture separator. The air, after passing through the moisture separator, is disbursed for use. The above description and the accompanying FIGS. 1, 7 and 8 make it clear how the compressed air and coolant flow. As stated, the compressed air heat exchanger receives compressed air without the compressed air first passing through the coolant heat exchanger. The coolant heat exchanger receives coolant without the coolant first passing through the compressed air heat exchanger.

Applicant's cooler fan shroud assembly has several advantages. Placing the first and second heat exchangers axially opposite each other improves cooling efficiency. In previous cooler fan assemblies air was blown through both the first and second heat exchangers. It is, however, more efficient to blow air over a water cooler and suck air through an aftercooler.

Applicant's cooler fan shroud assembly further improves manufacturing ease and reduces costs. Previous cooler fan assemblies had a very tight working area around the two exchangers. The limited working area necessitated a need for complex and costly piping. Applicant's cooler fan assembly which disposes the heat exchangers axially opposite each other increases working space. The increased working space reduces the need for complex piping. In addition, Applicant's assembly which disposes the heat exchangers relative to a cooler fan negates the need for a fan guard. Eliminating the fan guard further reduces manufacturing costs.

Additionally Applicant's cooler fan assembly helps to reduce noise level. Previous cooler fan assemblies had a high degree of noise. Applicant's assembly, by disposing the cooler fan within the shroud, significantly reduces noise level. In addition, Applicant's heat exchangers which produce higher cooling efficiency allow the use of a smaller and less noisy fan motor and fan blades thereby further reducing the noise level.

It should be understood that although the above example describes a cooler fan assembly utilizing a water cooler and aftercooler, the cooler fan assembly could use another type of heat exchanger such as one used with oil. In addition it is contemplated that the cooler fan assembly could be mounted on a compressor so that the air flow produced by the cooler fan flows transversely relative to the base of the compressor rather than axially away from the base.

It is important to note therefore that the present invention has been described with reference to a specific exemplary embodiment thereof. It would be apparent to those skilled in the art that a person understanding this invention may conceive of changes or other embodiments or variations which utilize the principles of the invention with departing from the broader spirit and scope of the invention as set forth in the appended claims. All are considered within the spirit and scope of the invention. The specifications and drawings are therefore to be regarded in an illustrative rather than restrictive sense. Accordingly, it is not intended that the invention be limited except as may be necessary in view of the appended claims.

What is claimed is:

1. A cooler fan assembly for an air compressor comprising:

a shroud, said shroud having an air inlet portal and an air discharge portal;

a means to produce an air flow, said means to produce an air flow disposed within said shroud;

an air passageway defined by said shroud, said air passageway guiding said air flow in a path having a direction into said inlet portal and out of said discharge portal;

a compressed-air heat exchanger at a first end of said shroud, said compressed-air heat exchanger in the path of said air flow;

a coolant heat exchanger at a second end of said shroud, said coolant heat exchanger in the path of said air flow;

and wherein said coolant heat exchanger has a coolant exchanger inlet and a coolant exchanger outlet;

said compressed air heat exchanger has a compressed air exchanger inlet and a compressed air exchanger outlet, said compressed air exchanger inlet is fluidly coupled to a separator;

said separator provides means to separate coolant from compressed air, both discharged into said separator from an air end;

said compressed air exchanger inlet defines a portion of a first pathway which receives said separated compressed air from said separator, said coolant exchanger inlet defines a portion of a second pathway which receives said separated coolant from said separator; said first pathway receives the compressed air at a location from the separator different from where the second pathway receives the separated coolant.

2. The cooler fan assembly of claim 1 wherein a portion of said shroud defines a constricted air passageway, and wherein said constricted air passageway is in the path of said air flow, and said constricted air passageway is axially spaced from said air inlet portal and said air discharge portal.

3. The cooler fan assembly of claim 1 wherein said compressed-air heat exchanger is axially opposite said coolant heat exchanger.

4. The cooler fan assembly of claim 3 wherein said compressed-air heat exchanger covers said inlet portal and wherein said coolant heat exchanger covers said discharge portal.

5. The cooler fan assembly of claim 1 wherein a portion of a fan blade is axially closer to said constricted air passageway than to said inlet portal and than to said discharge portal.

6. A cooler fan assembly for an air compressor comprising:

a shroud, said shroud having an air inlet portal and an air discharge portal;

a means to produce an air flow, said means to produce an air flow disposed within said shroud;

an air passageway defined by said shroud, said air passageway guiding said air flow in a path having a direction into said inlet portal and out of said discharge portal;

a compressed-air heat exchanger at a first end of said shroud said compressed-air heat exchanger in the path of said air flow;

a coolant heat exchanger at a second end of said shroud, said coolant heat exchanger in the path of said air flow, and wherein said shroud is vertically above a compressor motor.

7. The cooler fan assembly of claim 4 further comprising:

a leg portion forming a part of a mounting structure, said leg portion attached to a compressor platform;

an arm portion forming a part of a mounting structure, said arm portion extending transversely to said leg portion, said arm portion supporting said shroud.

8. A cooler fan assembly for an air compressor comprising:

a shroud, said shroud having an air inlet portal and an air discharge portal;

a means to produce an air flow, said means to produce an air flow disposed within said shroud;

an air passageway defined by said shroud, said air passageway guiding said air flow in a path having a direction into said inlet portal and out of said discharge portal;

a compressed-air heat exchanger at a first end of said shroud, said compressed-air heat exchanger in the path of said air flow;

a coolant heat exchanger at a second end of said shroud, said coolant heat exchanger in the path of said air flow and wherein;

said compressed-air heat exchanger is fluidly connected to an air end to receive compressed air without said compressed air first passing through said coolant heat exchanger;

said coolant heat exchanger is fluidly connected to said air end to receive coolant without said coolant first passing through said compressed-air heat exchanger.

9. The cooler fan assembly of claim 8 further comprising:

a separator, said separator fluidly connected to said compressed air heat exchanger and to said coolant heat exchanger, said separator fluidly connected to said air end to receive from said air end, said coolant and compressed air, said separator provides means to distribute said compressor air to pass into said compressed air heat exchanger and said coolant into said coolant heat exchanger.

10. The cooler fan assembly of claim 8 further comprising:

a separator, said separator fluidly connected to said compressed air heat exchanger and to said coolant heat exchanger and wherein said coolant and compressed air both pass from said air end into said separator, said separator forming means to separate said coolant from said compressed air and to distribute said compressed air into said compressed air heat exchanger and said coolant into the coolant heat exchanger.

11. A cooler fan assembly for an air compressor comprising:

a shroud, said shroud having an air inlet portal and an air discharge portal;

a means to produce an air flow, said means to produce an air flow disposed within said shroud;

an air passageway defined by said shroud, said air passageway guiding said air flow in a path having a direction into said inlet portal and out of said discharge portal;

a compressed-air heat exchanger at a first end of said shroud, said compressed-air heat exchanger in the path of said air flow;

a coolant heat exchanger at a second end of said shroud, said coolant heat exchanger in the path of said air flow and and wherein said inlet portal is axially opposite said discharge portal.

12. A cooler fan assembly adapted for use as a part of an air compressor, said cooler fan assembly comprising:

a shroud, said shroud having an air inlet portal and an air discharge portal;

a means to produce an air flow, said means to produce an air flow being completely disposed within said shroud;

an air passageway defined by said shroud, said air passageway guiding said air flow to move in a path having a direction into said inlet portal and out of said discharge portal;

a compressed-air heat exchanger at a first end of said shroud, said compressed-air heat exchanger in the path of said air flow, said compressed air heat exchanger fluidly connected to an air end;

a coolant heat exchanger at a second end of said shroud, said coolant heat exchanger in the path of said air flow, said means to produce an air flow between said coolant heat exchanger and said compressed-air heat exchanger;

and wherein said compressed air heat exchanger has a compressed air inlet and a compressed air outlet, said compressed air inlet, said compressed air outlet, and said air end form a portion of a compressed air pathway, said compressed air pathway is open ended.

* * * * *